US005602359A

United States Patent [19]

Hambro et al.

[11] Patent Number: 5,602,359

[45] Date of Patent: Feb. 11, 1997

[54] AIRBAG INGNITER WITH INTEGRAL SENSITIVITY IDENTIFICATION

[75] Inventors: Roger S. Hambro, Orefield, Pa.; Glenn R. Chatley, Mesa, Ariz.

[73] Assignee: ICI Americas, Inc., Wilmington, Del.

[21] Appl. No.: 514,615

[22] Filed: Aug. 14, 1995

[51] Int. Cl.[6] ..... F42C 11/00

[52] U.S. Cl. ..... 102/202.5; 102/202.14; 102/293; 102/530; 280/741

[58] Field of Search ..... 102/202.5, 202.14, 102/530, 531, 293; 280/741; 376/451, 452

[56] References Cited

U.S. PATENT DOCUMENTS

| | | | |
|---|---|---|---|
| 1,632,156 | 6/1927 | Wiley | 102/501 |
| 1,650,908 | 11/1927 | Ramsey | 102/430 |
| 1,887,324 | 11/1932 | Pocoroba | 102/501 |
| 3,575,111 | 4/1971 | Richardson | 102/334 |
| 4,007,085 | 2/1977 | Woodacre | 376/452 |
| 4,222,330 | 9/1980 | Krystymiak | 102/501 |
| 5,140,906 | 8/1992 | Little, II | 102/202.14 |
| 5,485,789 | 6/1996 | Collier | 102/501 |

*Primary Examiner*—Harold J. Tudor
*Attorney, Agent, or Firm*—Howson and Howson

[57] ABSTRACT

In a set of airbag igniters, each igniter has a mounting ring connected to and surrounding a portion of its body. Each igniter is supported in a retainer having an X-ray permeable wall surrounding the mounting ring. The mounting ring has a radially outwardly facing surface having a pattern of annular grooves hidden from visual inspection by the wall of the retainer. The pattern of grooves is the same for all of the igniters in the set having the same sensitivity, and any two igniters in the set having different sensitivities have different patterns of grooves. The grooves are inspected automatically by X-rays.

3 Claims, 2 Drawing Sheets

*Fig. 1*
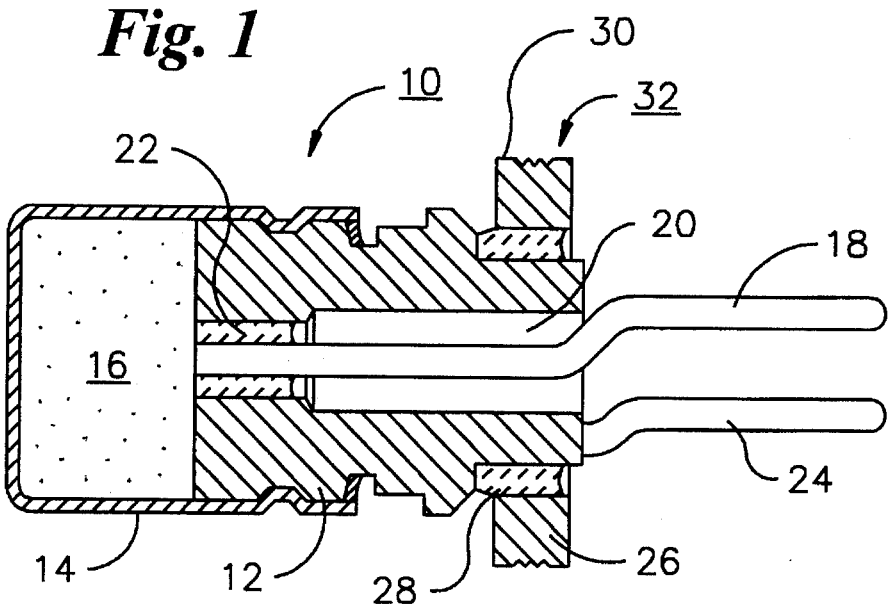
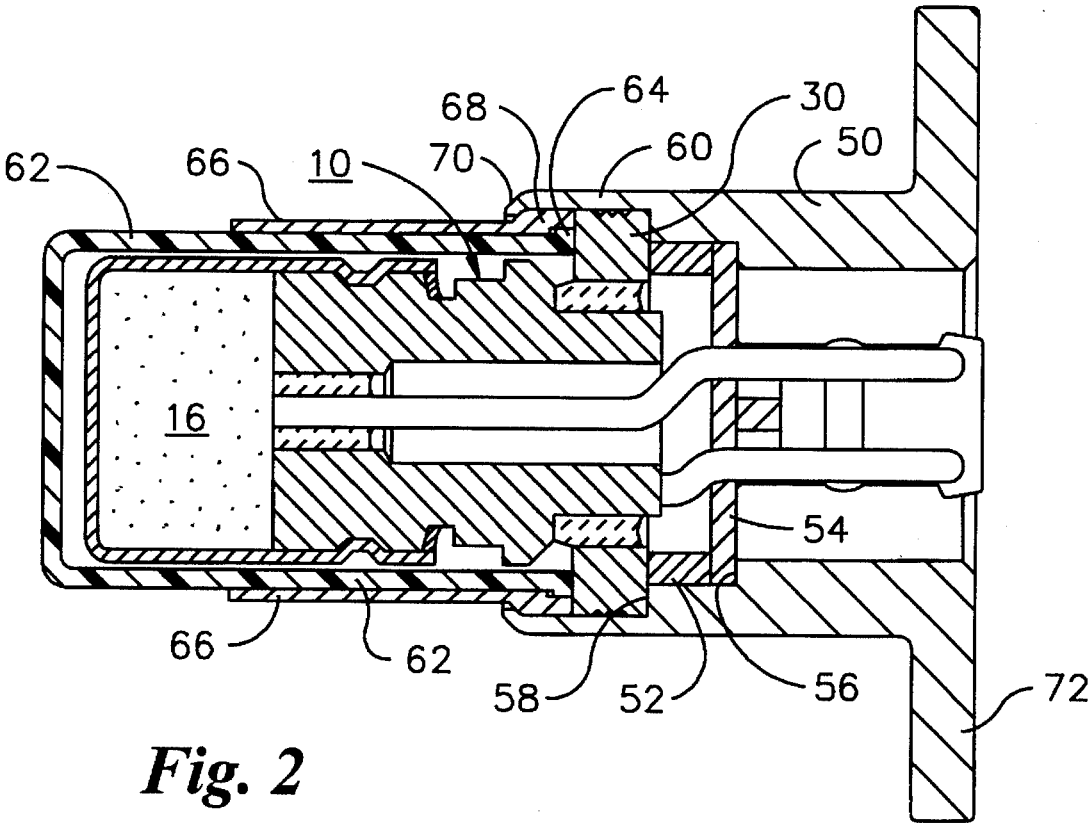
*Fig. 2*

AIRBAG INGNITER WITH INTEGRAL SENSITIVITY IDENTIFICATION

BRIEF SUMMARY OF THE INVENTION

This invention relates generally to igniters used in the deployment of automotive airbags. It relates more particularly to an improvements in the inspection of airbag igniters whereby different igniters, having different electrical sensitivities, can be readily distinguished from one another by automated inspection.

An airbag igniter is the first link in the explosive chain that results in the inflation of an automotive airbag. An electrical impulse received by the igniter from an impact sensor initiates the igniter. In the operation of the igniter, the electrical signal heats a bridge wire within the igniter, and heat is transferred from the bridge wire to the pyrotechnic material within the igniter.

The sensitivity of the igniter is a function of the length and diameter of the bridge wire, the bridge wire material, and the rate of heat transfer from the bridge wire to the pyrotechnic material within the igniter. With a more sensitive igniter, less electrical energy is required to effect initiation.

Igniters having different sensitivities are often otherwise substantially identical to one another in size and appearance. In production, igniters with different sensitivities occasionally become intermingled. Therefore, it has been necessary to provide a way to distinguish igniters from one another on the basis of their sensitivities.

Early igniter specifications called for devices requiring relatively large electrical signals for initiation. Igniters having different sensitivities had bridge wires with different electrical resistances. Therefore, in the past, it was easy to distinguish between igniters having different sensitivities, simply by measuring the electrical resistance between the igniter terminals.

More recently, however, efforts to simplify and reduce the weight and size of sensor systems have resulted in igniter specifications which require devices that can be initiated reliably by a relatively small electrical signal.

The trend toward airbag inflation systems with increased electrical sensitivity has led to a proliferation of sensitivity specifications, many of which call for the igniter to have a nominal resistance within a very limited range, i.e. 2.0 to 2.15 ohms. Thus, igniters having different sensitivities often have indistinguishable electrical resistances. Resistance measurement has therefore become useless for distinguishing igniters having different sensitivities from one another.

At a point in the production process, an igniter is also usually encased in a flanged retainer by which the igniter is mounted to an airbag canister. The retainers are generally the same for a variety of igniters having different sensitivities. Even if the igniter is marked by color or a similar marking scheme, the marking may be hidden by the canister. Therefore, unless the canister is also marked, the retainer will obscure the marking on the igniter and prevent the igniters from being distinguished from one another in subsequent steps in the production process.

The principal object of this invention is to provide a simple and cost-effective way to distinguish igniters having different sensitivities without measuring electrical resistance.

It is also an object of the invention to provide a way in which airbag igniters having different sensitivities can be readily distinguished from one another throughout the production process.

A still further object of the invention is to provide a simple way in which airbag igniters can be distinguished automatically on the basis of sensitivity, even after they are encased in their mounting retainers.

In accordance with the invention, each igniter in a set of airbag igniters has a radially outwardly facing surface having a pattern of annular grooves. The pattern of grooves is the same for all of the igniters in the set having the same sensitivity, and any two igniters in the set having different sensitivities have different patterns of grooves.

Preferably the grooves are formed in a ring by which the igniter is mounted in a mounting retainer. Although the grooves are hidden when the igniter is mounted in the retainer, the retainer has an X-ray permeable wall surrounding the mounting ring. Thus, the pattern of grooves can be inspected automatically by the use of X-rays.

The principal advantage of the invention is that it provides both for visual sensitivity identification, and for automatic sensitivity identification without electrical resistance measurement.

Further objects, advantages and details of the invention will be apparent from the following detailed description, when read in conjunction with the drawings.

BRIEF DESCRIPTION OF THE DRAWINGS

FIG. 1 is an axial section of an airbag igniter in accordance with the invention;

FIG. 2 is an axial section showing the airbag igniter of FIG. 1 mounted in a retainer;

DETAILED DESCRIPTION

Figure 3:
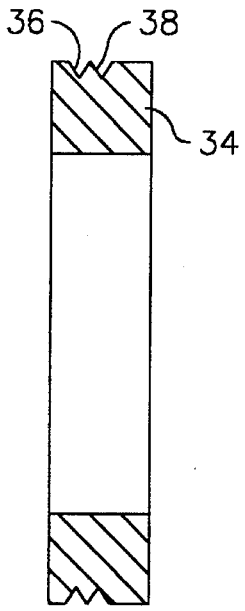
FIGS. 3, 4 and 5 are axial sections of igniter mounting rings, illustrating the identification grooves.

The airbag igniter 10, shown in FIG. 1, comprises an igniter body 12. A cup-shaped cap 14, containing a pyrotechnic charge 16, is attached to a front portion of the igniter body.

In practice the pyrotechnic charge may contain two or more different sections, for example a heat-ignitable section of barium styphnate and a base charge consisting of a mixture of titanium and potassium perchlorate.

The heat-ignitable material is in contact with a bridge wire (not shown), which is connected electrically between the igniter body 12 and a terminal pin 18, which extends through a passage 20 in the igniter body to the rear of the body, where it can be connected to a leadwire. Pin 18 is insulated from the igniter body 12 by glass insulator material 22. A second terminal pin 24 is secured to the igniter body 12, and extends parallel to pin 18 to the rear of the igniter body.

A mounting ring 26 surrounds the rear portion of the igniter body, and is fixed to the igniter body, while being electrically insulated therefrom, by glass insulation 28. The ring has a radially outwardly facing surface 30, in which is machined a pattern of annular grooves 32, the pattern being a binary-coded representation of the igniter sensitivity.

Figure 4:
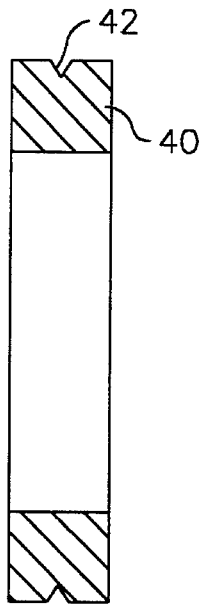

The pattern of grooves may consist of a single groove, or more than one groove. In the embodiment shown, there are three possible groove positions. In FIG. 1, grooves are provided in all three positions. In ring 34, shown in FIG. 3, grooves 36 and 38 are provided in the first two positions. In ring 40, shown in FIG. 4, a single groove 42 is provided in the second position. In ring 44, shown in FIG. 4, grooves 46 and 48 are provided in the first and third positions respectively.

Figure 5:
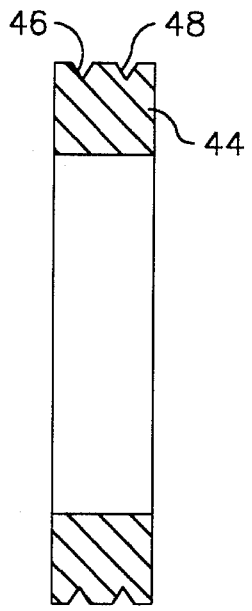

With three groove positions, it is possible to encode as many as eight different igniter sensitivities. In practice, however, it may be desirable to eliminate rings with no grooves, and it may even be desirable to provide a different number of grooves for each different sensitivity level. Thus, pattern such as those in FIG. 1 (three grooves), FIG. 4 (one groove) and FIG. 5 (two grooves) might be used, while other patterns such as the two groove pattern of FIG. 3 might not be used. This makes it easier to differentiate the igniters from one another, especially when automatic scanning is used. On the other hand, it limits the number of different sensitivities which can be distinguished using a given maximum number of grooves. The maximum number of grooves, of course, can be increased.

Turning to FIG. 2, the igniter 10 is shown mounted in a retainer 50. Ring 30 lies against a compliant washer 52, which, in turn, engages a ring 54 bearing against an internal shoulder 56 in the retainer. Ring 30 also engages an internal shoulder 58 in the retainer. The grooved face of the ring is covered by a thin portion 60 of the wall of the retainer.

The igniter body 10 extends into an insulating cup 62, having a flange 64. The insulating cup fits into a sleeve 66, having an enlarged end 68 which is extends into the retainer where it is held by a crimped part 70 of the thin wall portion 60. Flange 64 is held in a recess in the enlarged end 68 of sleeve 66. The end of cup 62 and the end of sleeve 66 both engage a side wall of ring 30, so that ring 30 is securely held in place in the retainer between the ends of cup 62 and sleeve 66 on one side, and washer 52 and shoulder 58 on the other side.

The retainer has a mounting flange 72, which, in the final assembly of the airbag system, is welded to an airbag canister (not shown).

The thin portion 60 of the retainer wall is X-ray permeable. Therefore, the groove pattern in the outwardly facing surface of ring 30 can be discerned by X-ray inspection apparatus.

Figure 6:
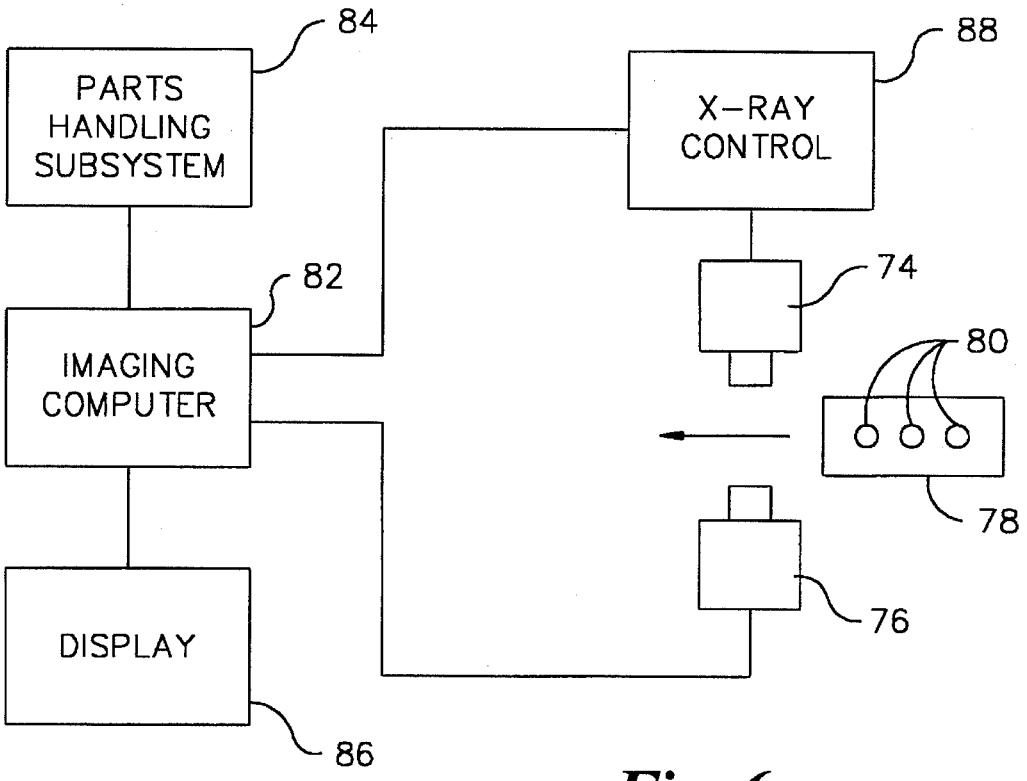
FIG. 6 is a schematic diagram of an automated inspection apparatus suitable for X-ray inspection of the igniters in accordance with the invention.

The X-ray inspection apparatus, shown schematically in FIG. 6, comprises an X-ray tube 74, and a detection device 76, which is preferably a charge-coupled device (CCD) camera situated opposite to the X-ray tube on the other side of the path of travel of a pallet 78 carrying a group of igniter assemblies (including retainers) to be inspected. The video output of the detection device 76 is fed to an imaging computer 82. In the imaging computer, the variations in the video signal corresponding to the grooves in the ring of the igniter assembly being scanned are detected, and the groove pattern is identified. Thus, the sensitivities of the igniters in the igniter assemblies being scanned are determined in the imaging computer. The imaging computer sends a signal to a parts handling subsystem 84 for sorting igniter assemblies in accordance with the sensitivities of their igniters. A video image can also be displayed on display monitor 84 for visual observation. Finally, the imaging computer provides an output to an X-ray control 88.

As will be apparent from the foregoing description, the invention provides a simple and cost-effective way to distinguish airbag igniters having different sensitivities throughout the production process, even after they are encased in their mounting retainers. It provides both for visual sensitivity identification, and for automatic sensitivity identification without electrical resistance measurement. Because the grooves extend all the way around the grooved mounting ring, their profile can be detected regardless of the orientation of the igniter body.

Various modifications can be made to the invention. For example, while the outwardly facing grooved surface is generally in the form of a cylinder having one or more grooves machined in it, as an alternative, the grooved surface can be conical or curved, but must face outwardly; it cannot be radial or face inwardly.

The grooves are preferably formed in the mounting ring so that they are located just inside the thin, X-ray permeable wall of the retainer in the assembly, but can be formed in other portions of the igniter.

Other modifications and applications, which will occur to persons skilled in the art, may be made without departing from the scope of the invention as defined in the following claims.

We claim:

1. In an airbag igniter having an igniter body, a pyrotechnic charge and electrical means for causing ignition of said charge, the improvement comprising a ring attached to the igniter body and surrounding a portion of the igniter body, and a pattern of annular grooves in the ring, the pattern of annular grooves indicating the sensitivity of the electrical means, in which the ring is a mounting ring having an outwardly facing surface, in which the pattern of annular grooves is formed in said outwardly facing surface, and including a supporting retainer having a wall and means securing the mounting ring in fixed relation to the retainer whereby the pattern of grooves is hidden from visual inspection by said wall of the supporting retainer, and in which said wall of the supporting retainer is X-ray permeable, whereby said grooves can be inspected automatically by means of an X-ray source and X-ray detection means.

2. In a set of airbag igniters each comprising an igniter body, a pyrotechnic charge and electrical means for causing ignition of said charge, in which the electrical means of at least one of the igniters in the set has a sensitivity different from the sensitivity of the electrical means of at least one other igniter in the set, the improvement comprising a pattern of annular grooves on each of said igniters, the pattern of annular grooves being the same for all of the igniters in the set having the same sensitivity, and any two igniters in the set having different sensitivities having different patterns of annular grooves, in which each igniter in the set has a mounting ring connected to its igniter body and surrounding a portion of its igniter body, a supporting retainer having a wall surrounding the mounting ring, and means securing the mounting ring in fixed relation to the retainer, the mounting ring having a radially outwardly facing surface, in which the pattern of annular grooves for each igniter in the set is formed in said outwardly facing surface, whereby the pattern of grooves is hidden from visual inspection by said wall of the supporting retainer, and in which said wall of the supporting retainer is X-ray permeable, whereby said grooves can be inspected automatically by means of an X-ray source and X-ray detection means.

3. A method of distinguishing different airbag igniters in a set of airbag igniters each comprising an igniter body, a pyrotechnic charge and electrical means for causing ignition of said charge, in which the electrical means of at least one of the igniters in the set has a sensitivity different from the sensitivity of the electrical means of at least one other igniter in the set, wherein a pattern of annular grooves is provided on each of said igniters, the pattern of annular grooves being the same for all of the igniters in the set having the same sensitivity, and any two igniters in the set having different sensitivities having different patterns of annular grooves, in which each igniter in the set has a mounting ring connected to its igniter body and surrounding a portion of its igniter body, a supporting retainer having a wall surrounding the mounting ring, and means securing the mounting ring in fixed relation to the retainer, the mounting ring having a radially outwardly facing surface, in which the pattern of annular grooves for each igniter in the set is formed in said outwardly facing surface, whereby the pattern of grooves is hidden from visual inspection by said wall of the supporting retainer, and in which said wall of the supporting retainer is X-ray permeable, comprising the step of inspecting said grooves by positioning said igniters in the path of X-rays between an X-ray source and X-ray detection means.

* * * * *